350-332 SR
4/7/87 XR 4,656,470

United States Patent [19]

Saka

[11] Patent Number: 4,656,470

[45] Date of Patent: Apr. 7, 1987

[54] TIMESHARING DRIVER FOR LIQUID CRYSTAL DISPLAY DEVICE

[75] Inventor: Masakazu Saka, Nara, Japan

[73] Assignee: Sharp Kabushiki Kaisha, Osaka, Japan

[21] Appl. No.: 506,834

[22] Filed: Jun. 22, 1983

[30] Foreign Application Priority Data

Jun. 10, 1982 [JP] Japan ..... 57-100171

[51] Int. Cl.[4] ..... G09G 3/00

[52] U.S. Cl. ..... 340/805; 340/784; 340/765; 340/811; 350/332

[58] Field of Search ..... 340/784, 805, 765, 802, 340/811; 350/332, 333

[56] References Cited

U.S. PATENT DOCUMENTS

| | | | |
|---|---|---|---|
| 3,995,942 | 12/1976 | Kawakami et al. | 340/784 |
| 4,076,385 | 2/1978 | Kondo | 340/765 |
| 4,187,505 | 2/1980 | Morley et al. | 350/333 |
| 4,300,137 | 11/1981 | Fujita et al. | 340/784 |
| 4,395,709 | 7/1983 | Magae et al. | 340/811 |
| 4,429,304 | 1/1984 | Fujita | 340/805 |

*Primary Examiner*—Gerald L. Brigance
*Assistant Examiner*—Jeffery A. Brier
*Attorney, Agent, or Firm*—Birch, Stewart, Kolasch & Birch

[57] ABSTRACT

A circuit for driving a display of an electronic apparatus including first supply means for applying a power source voltage E to at least one selected picture element during a display period to display it and for applying each of a first voltage $V_1$ and a second voltage $V_2$ to said at least one selected picture element for each half interval during a non-display period, and second supply means for applying the zero voltage to at least one non-selected picture element during the display period to erase it and for applying each of the first voltage $V_1$ and the second voltage $V_2$ to said at least one non-selected picture element for each half interval during the non-display period, where $$0 \leqq V_1 < V_2 \leqq E$$

$$V_1 + V_2 = E.$$

8 Claims, 7 Drawing Figures

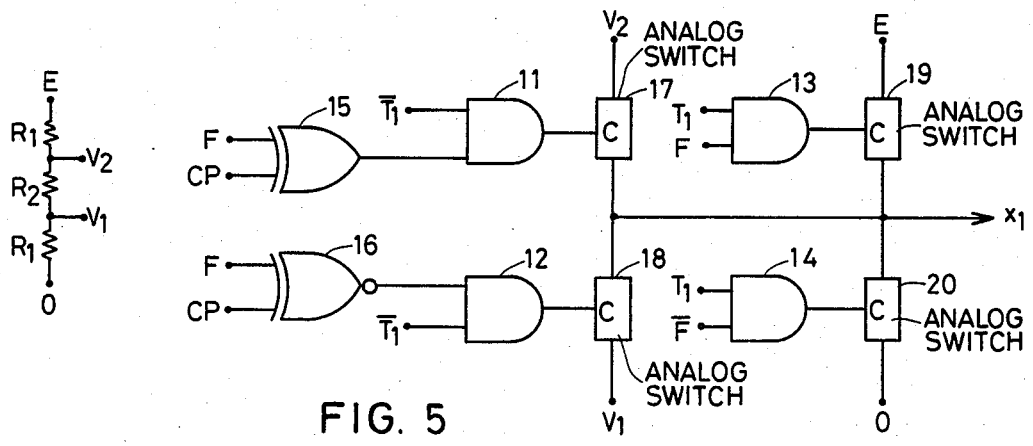
FIG. 5
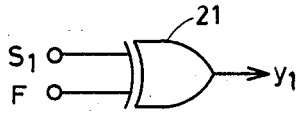
FIG. 6
FIG. 7
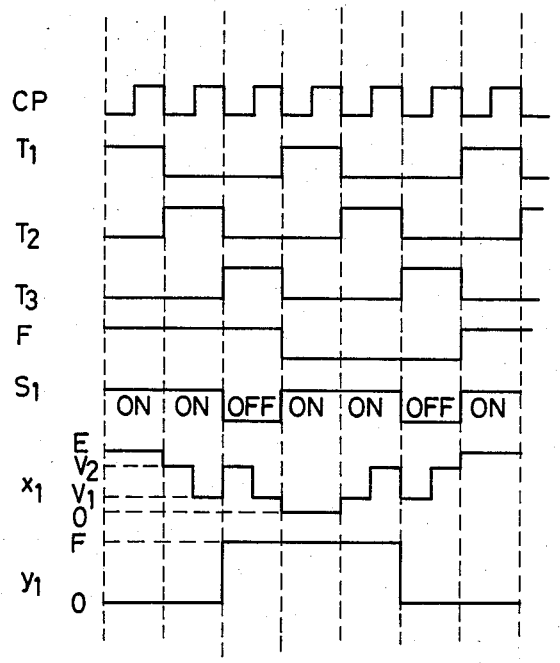

TIMESHARING DRIVER FOR LIQUID CRYSTAL DISPLAY DEVICE

BACKGROUND OF THE INVENTION

The present invention relates to a driver for a display device and, more particularly, to a timesharing circuit for driving a liquid crystal display device.

Conventionally, liquid crystal display devices are driven in a $\frac{1}{3}$ bias$-\frac{1}{3}$ duty drive mode or a $\frac{1}{2}$ bias$-\frac{1}{3}$ duty drive mode. The effective value of the voltage to be applied to each of picture elements is given as follows: $\frac{1}{3}$ bias$-\frac{1}{3}$ duty drive mode:

picture elements selected to be displayed:

$$V_{ON}=0.638E$$

picture elements selected not to be displayed:

$$V_{OFF}=0.333E$$

$\frac{1}{2}$ bias$-\frac{1}{3}$ duty drive mode:

$$V_{ON}=0.707E$$

$$V_{OFF}=0.408E$$

where E: the voltage of a power source

The $\frac{1}{2}$ bias$-\frac{1}{3}$ duty drive mode is superior to the $\frac{1}{3}$ bias$-\frac{1}{3}$ duty drive mode since a higher effective value of the voltage is applied to the picture elements in the $\frac{1}{2}$ bias$-\frac{1}{3}$ duty drive mode.

Recently, electronic apparatuses such as calculators, timepieces or the like tend to be equipped with a solar battery as a power source, so that it is desired that they be driven with a relatively low power as much as possible.

While the circuits of the electronic apparatus do not consume much power on account of integrated circuits, the displays thereof consume considerable power, so that it is desirable to reduce the power to be consumed by the displays.

OBJECT AND SUMMARY OF THE INVENTION

Accordingly, it is an object of the present invention to provide an improved driver for a display of an electronic apparatus.

It is another object of the present invention to provide an improved timesharing circuit for driving a liquid crystal display of an electronic apparatus.

Briefly described, in accordance with the present invention, a timesharing circuit for driving a liquid crystal display of an electronic apparatus comprises first supply means for applying a power source voltage E to at least one selected picture element during a display period to display it and for applying each of a first voltage $V_1$ and a second voltage $V_2$ to said at least one selected picture element for each half interval during a non-display period, and second supply means for applying the zero voltage to at least one non-selected picture element during the display period to erase it and for applying each of the first voltage $V_1$ and the second voltage $V_2$ to said at least one non-selected picture element for each half interval during the non-display period, where $$0 \leqq V_1 < V_2 \leqq E$$

$$V_1+V_2=E$$

BRIEF DESCRIPTION OF THE DRAWINGS

The present invention will become more fully understood from the detailed description given hereinbelow and accompanying drawings which are given by way of illustration only, and thus are not limitative of the present invention and wherein:

FIG. 5 shows a circuit configuration of a scan electrode driver in the circuit of FIG. 4;

FIG. 6 shows a circuit configuration of a signal electrode driver in the circuit of FIG. 4; and FIG. 7 shows a timechart of signals occurring within the drivers of FIGS. 5 and 6.

DESCRIPTION OF THE INVENTION

A driver of an electronic apparatus such as a calculator, a timepiece or the like can be applied to drive any type of display. For description, a liquid crystal display device of a 3×3 matrix arrangement is exemplified.

Figure 1:
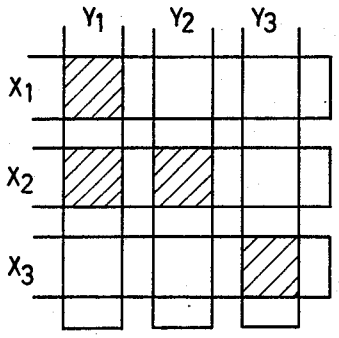
FIG. 1 shows a structure of an electrode adapted for a 3×3 matrix liquid crystal display device.

FIG. 1 shows a structure of an electrode to form a 3×3 matrix liquid crystal display device. The electrode of FIG. 1 comprises three scan electrodes $X_1$ to $X_3$, and three signal electrodes $Y_1$ to $Y_3$. The shaded areas indicate picture segments selected to be displayed. The remaining white areas indicate picture segments selected not to be displayed.

Figure 2:
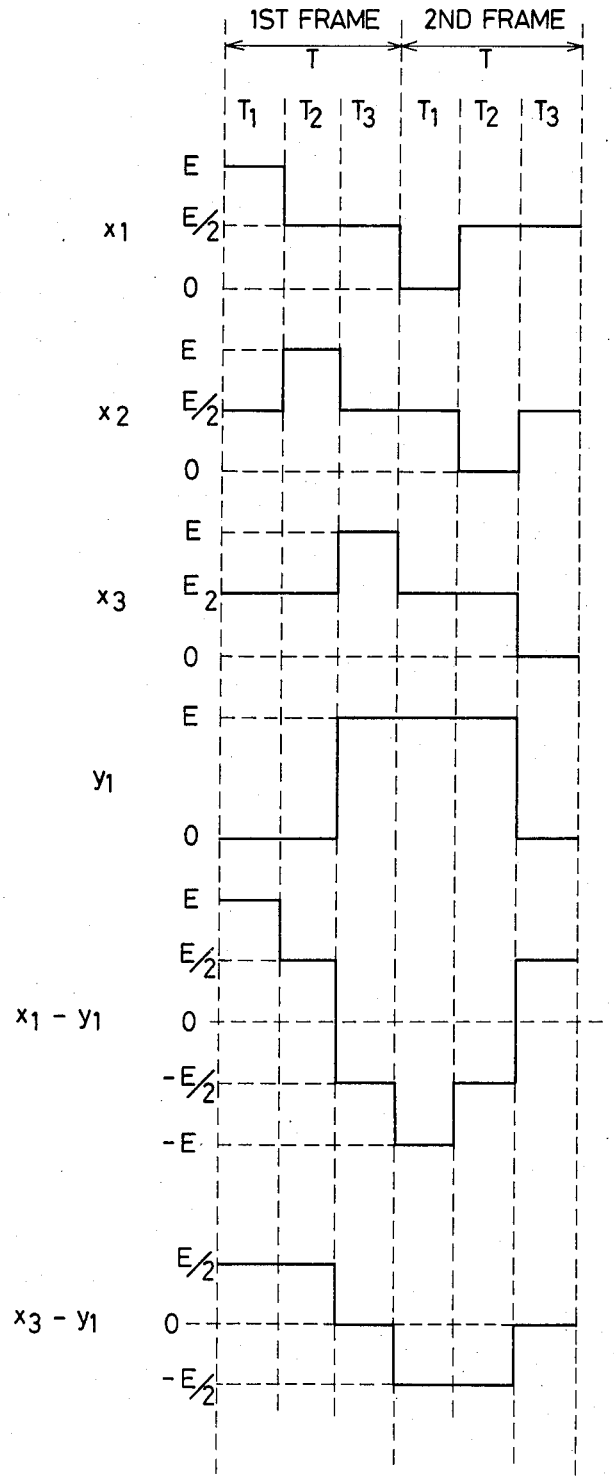
FIG. 2 shows a timechart of signals to be applied for a $\frac{1}{2}$ bias$-\frac{1}{3}$ duty drive mode.
Figure 3:
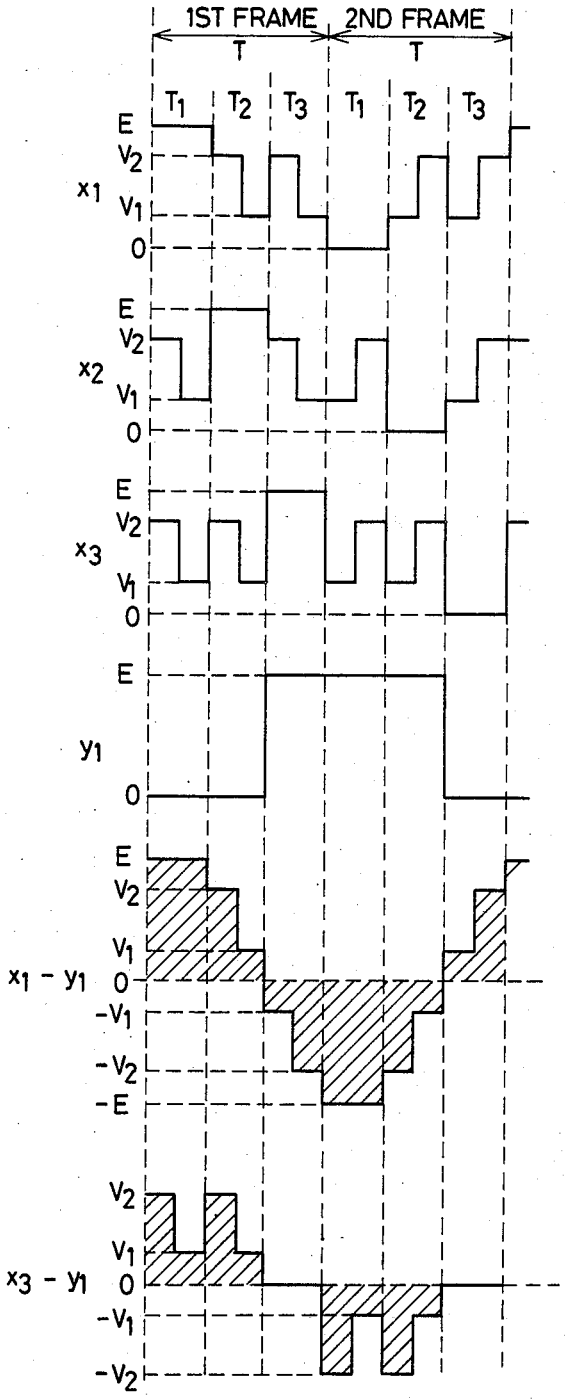
FIG. 3 shows a timechart of signals to be applied for a drive mode of the present invention.

FIGS. 2 and 3 show a timechart of voltage signals for driving the liquid crystal display. FIG. 2 is related to a $\frac{1}{2}$ bias$-\frac{1}{3}$ duty drive mode and FIG. 3 is related to the present invention.

In FIGS. 2 and 3, $x_n$ signals are applied to the scan electrode $X_n$ (n=1, 2, 3). $y_n$ signals are applied to the signal electrode $Y_n$ (n=1, 2, 3). $(x_1-y_1)$ signals are applied to a crossover segment between the scan electrode $X_1$ and the signal electrode $Y_1$, this crossover segment being displayed. $(x_3-y_1)$ signals are applied to another crossover segment between the scan electrode $X_3$ and the signal electrode $Y_1$, said another crossover segment being not displayed.

The $x_1$ signals of FIG. 3 will be specifically described. Table I shows the voltage change of the $x_1$ signals.

TABLE I

| 1st Frame | | 2nd Frame | |
|---|---|---|---|
| Selected Period ($T_1$) | Non-Selected Period ($T_2$, $T_3$) | Selected Period ($T_1$) | Non-Selected Period ($T_2$, $T_3$) |
| E(T) | $V_2\left(\frac{T}{2}\right) \rightarrow$ | 0(T) | $V_1\left(\frac{T}{2}\right) \rightarrow$ |
| | $V_1\left(\frac{T}{2}\right) \rightarrow$ | | $V_2\left(\frac{T}{2}\right) \rightarrow$ |
| | $V_2\left(\frac{T}{2}\right) \rightarrow$ | | $V_1\left(\frac{T}{2}\right) \rightarrow$ |

TABLE I-continued

| 1st Frame | | 2nd Frame | |
|---|---|---|---|
| Selected Period ($T_1$) | Non-Selected Period ($T_2$, $T_3$) | Selected Period ($T_1$) | Non-Selected Period ($T_2$, $T_3$) |
| | $V_1\left(\frac{T}{2}\right) \rightarrow$ | | $V_2\left(\frac{T}{2}\right) \rightarrow$ |

Two voltages $V_1$ and $V_2$ and a power source voltage E satisfy the following equation:

$$0 \leqq V_1 < V_2 \leqq E$$

$$V_1 + V_2 = E$$

The contents of the parentheses following the voltage value indicate a period for continuing the voltage value. The 1st and the 2nd frames form a single cycle and the same signal waves are repeatedly applied.

According to the present invention, the power source voltage E is applied to the selected picture element during the display period to display it, and each of the first voltage $V_1$ and the second voltage $V_2$ is applied to the picture element for a half interval during the non-display period. The zero voltage is applied to the non-selected picture element during the display period to erase it, and each of the first voltage $V_1$ and the second voltage $V_2$ is applied to the non-selected picture element for another half interval during the non-display period.

The $y_1$ signals have the same wave form as shown in FIG. 2.

According to the present invention, the effective value $V_{ON}$ of an enabling voltage applied to the displayed segment, the effective value $V_{OFF}$ of a disenabling voltage applied to the non-displayed segment, and an operation margin are given as follows:

$$V_{ON} = \sqrt{\frac{E^2 + V_1^2 + V_2^2}{3}}$$

$$V_{OFF} = \sqrt{\frac{V_1^2 + V_2^2}{3}}$$

$$\frac{V_{ON}}{V_{OFF}} = \sqrt{\frac{E^2 + V_1^2 + V_2^2}{V_1^2 + V_2^2}}$$

As the value of the operation margin is larger, the viewing angle becomes wider.

Table II shows the variations of these voltages when the voltages $V_1$ and $V_2$ are changed in a fixed condition of $0 \leqq V_1 < V_2 \leqq E$ and $V_1 + V_2 = E$

TABLE II

| | | | | |
|---|---|---|---|---|
| $V_1$ | $\frac{1}{4}$ E | $\frac{1}{8}$ E | $\frac{1}{16}$ E | O |
| $V_2$ | $\frac{3}{4}$ E | $\frac{7}{8}$ E | $\frac{15}{16}$ E | E |
| $V_{ON}$ | 0.736 E | 0.771 E | 0.792 E | 0.816 E |
| $V_{OFF}$ | 0.456 E | 0.510 E | 0.542 E | 0.577 E |
| $\frac{V_{ON}}{V_{OFF}}$ | 1.614 | 1.512 | 1.461 | 1.414 |

As the first voltage $V_1$ nears O and the second voltage $V_2$ nears E, the voltages $V_{ON}$ and $V_{OFF}$ become high and the margin $V_{ON}/V_{OFF}$ becomes small.

The margin of 1.414 corresponds to that of a $\frac{1}{4}$ bias—1/9 duty drive mode. Recently, as the liquid crystal displays have become suitable for a $\frac{1}{8}$ duty, a 1/10 duty, a 1/32 duty drive mode or the like, the margin in the drive mode according to the present invention has become practical.

Figure 4:
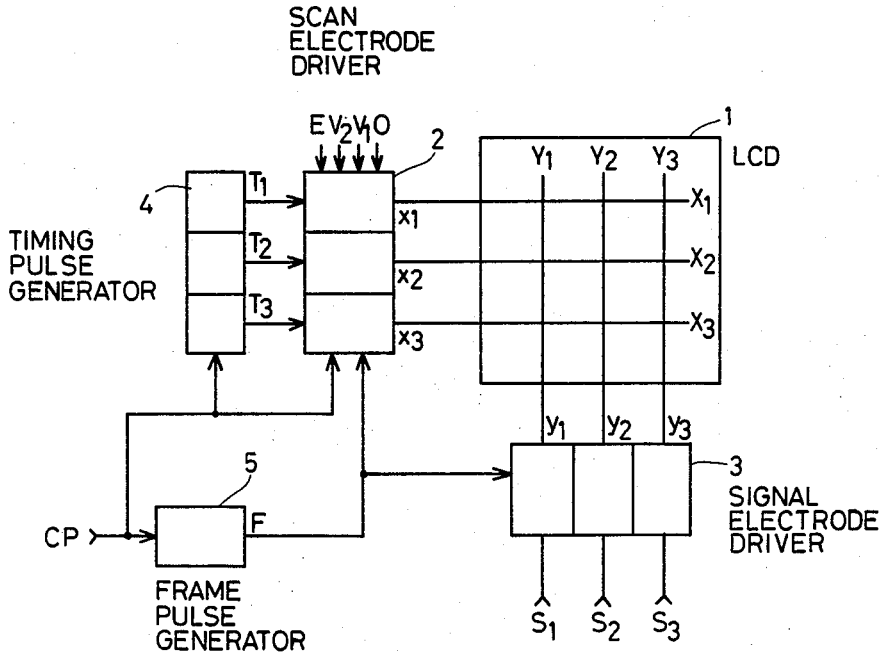
FIG. 4 shows a block diagram of a circuit for generating the signals of FIG. 3.

FIG. 4 shows a block diagram of a circuit for generating the signals according to the present invention. The circuit comprises a liquid crystal display (LCD) 1, a scan electrode driver 2, a signal electrode driver 3, a timing pulse generator 4, and a frame pulse generator 5. The timing pulse generator 4 develops timing pulses $T_1$ to $T_3$ for defining the selection periods of the respective scan electrodes. The frame pulse generator 5 develops a frame pulse F for defining a frame cycle $T(=T_1+T_2+T_3)$. In FIG. 4, CP indicates a clock pulse and $S_1$ to $S_3$ indicate segment selection signals.

FIG. 5 shows part of the scan electrode driver 2 for generating the $x_1$ signals applied to the scan electrode $X_1$.

The first voltage $V_1$ and the second voltage $V_2$ are obtained by dividing the power source voltage E with resistors. The clock pulse CP, the timing pulse $T_1$ for defining the selection period of the scan electrode $X_1$, and the frame pulse F for defining the frame cycle T are provided.

The part of the scan electrode driver 2 of FIG. 5 comprises four AND gates 11 to 14, two exclusive OR gates 15 and 16, and four analog switches 17 to 20. When an input signal in a high level is applied to a control gate c of each of the four analog switches 17 to 20, said each of the analog switches 17 to 20 becomes conductive.

A like circuit corresponding to that of FIG. 5 is provided for generating each of the $x_2$ and the $x_3$ signals applied to each of the scan electrode $X_2$ and $X_3$.

FIG. 6 shows part of the signal electrode driver 3 for generating the $y_1$ signals applied to the signal electrode $Y_1$.

The part of the signal electrode driver 3 of FIG. 6 comprises an exclusive OR gate 21 for outputting the $y_1$ signals in response to the input of the segment selection signal $S_1$ and the frame pulse F.

A like circuit corresponding to that of FIG. 6 is provided for generating each of the $y_2$ and the $y_3$ signals applied to each of the signal electrodes $Y_2$ and $Y_3$.

FIG. 7 shows a timechart of the signals occurring within the circuits of FIGS. 5 and 6.

While only certain embodiments of the present invention have been described, it will be apparent to those skilled in the art that various changes and modifications may be made therein without departing from the spirit and scope of the invention as claimed.

What is claimed is:

1. A circuit for driving a display of an electronic apparatus, said display having N scan electrodes and M signal electrodes (where M and N are positive integers) with a plurality of display elements disposed therebetween, each said scan electrode addressing M display elements, each said signal electrode addressing N display elements, said circuit comprising:

scan electrode drive means for driving each of said scan electrodes with a scan waveform having four discrete voltage levels, a high level, a low level, and first and second intermediate voltage levels, said scan waveform having first and second frame periods, each divided into N sub-periods, said first frame period defining a display writing period, and said second frame period defining a display erasing period, said scan means driving each of said N scan electrodes in a corresponding N sub-period with said high voltage level in said first frame period and said low voltage in said second frame period, said scan drive means alternately applying said first and second intermediate voltage levels to each of said N scan electrodes in all other said sub-periods, said first intermediate voltage level being applied during one half of the said other sub-period, and said second intermediate voltage level being applied during a second half of the said other sub-period;

signal electrode drive means for driving each of said signal electrodes with a signal waveform formed of said high and low voltage levels, said low voltage level being developed on each M signal electrode during a N sub-period of said first frame period and said high voltage level being developed during the N subperiod of said second frame period in order to selectively display the display element disposed between said M signal electrode and N scan electrode during the first frame period and selectively erase a displayed element during the second frame period;

each said display element being driven in a scanned manner by said scan electrode drive means and signal electrode drive means to thereby drive and selectively display each element of said display, said first and second intermediate voltage levels being different from each other to thereby reduce display energy consumption.

2. The circuit of claim 1, wherein the electronic apparatus comprises a calculator.

3. The circuit of claim 1, wherein the electronic apparatus comprises a timepiece.

4. The circuit of claim 1, wherein said scan electrode drive means comprises:

exclusive OR gate means for receiving a clock pulse and a frame pulse and for defining said first and second frame periods therefrom;

first AND gate means for receiving a timing pulse equal in duration to a said subperiod and associated with a said N scan electrode and the output of the exclusive OR gate means, the timing pulse defining a said N subperiod of said N scan electrode;

second AND gate means for receiving the timing pulse and said frame pulse; and analog switch means responsive to the outputs of the first AND gate means for switching said first intermediate voltage level to saie N scan electrode and the second AND gate means for switching said high level to said N scan electrode.

5. The circuit of claim 4 wherein said scan electrode drive means further comprises:

exclusive NOR gate means for receiving said clock pulse and said frame pulse;

third AND gate means for receiving the inverse of said timing pulse and the output of said exclusive NOR gate means;

fourth AND gate means for receiving said timing pulse and the inverse of said frame pulse;

said analog switch means further switching said second intermediate voltage level to said N scan electrode in response to the output of said third AND gate means, and for switching said low voltage level to said N scan electrode, in response to the output of said fourth AND gate means.

6. The circuit of claim 1, wherein said signal electrode drive means comprises:

exclusive OR gate means for inputting a segment selection signal and a frame pulse for defining a frame cycle and for outputting signals to be applied to each M signal electrode; said segment selecting signals determining which said display elements defined by said N scan electrodes and said M signal electrodes should be displayed.

7. The circuit of claim 1 wherein said low voltage level is zero volts, said high voltage level is E volts and where said first and second intermediate voltage levels equal E volts when added together.

8. The circuit of claim 1 further comprising solar battery means for driving said circuit and for providing a voltage of said high level thereto.

* * * * *